United States Patent [19]

Yutori et al.

[11] Patent Number: 4,578,124

[45] Date of Patent: Mar. 25, 1986

[54] HIGH STRENGTH LOW CARBON STEELS, STEEL ARTICLES THEREOF AND METHOD FOR MANUFACTURING THE STEELS

[75] Inventors: Toshiaki Yutori, Hyogo; Masatoshi Sudo, Kobe; Takehiko Kato, Kobe; Yasuhiro Hosogi, Kobe, all of Japan

[73] Assignee: Kabushiki Kaisha Kobe Seiko Sho, Kobe, Japan

[21] Appl. No.: 686,884

[22] Filed: Dec. 27, 1984

[30] Foreign Application Priority Data

| | | | |
|---|---|---|---|
| Jan. 20, 1984 | [JP] | Japan | 59-9055 |
| Jan. 20, 1984 | [JP] | Japan | 59-9056 |
| Aug. 24, 1984 | [JP] | Japan | 59-177191 |

[51] Int. Cl.[4] ..... C21D 7/14

[52] U.S. Cl. ..... 148/12 F; 148/12.4; 148/36; 148/12 B

[58] Field of Search ..... 148/12 F, 12.4, 36, 148/12 B

[56] References Cited

U.S. PATENT DOCUMENTS

| | | | |
|---|---|---|---|
| 4,108,695 | 8/1978 | Paulitsch et al. | 148/12 B |
| 4,406,713 | 9/1983 | Yutori et al. | 148/36 |
| 4,407,680 | 10/1983 | Gladman et al. | 148/12.4 |
| 4,501,626 | 2/1985 | Sudo et al. | 148/36 |

FOREIGN PATENT DOCUMENTS

| | | | |
|---|---|---|---|
| 44723 | 4/1981 | Japan | 148/36 |
| 133423 | 10/1981 | Japan | 148/12 F |
| 29554 | 2/1982 | Japan | 148/36 |
| 2076425 | 12/1981 | United Kingdom | 148/36 |

OTHER PUBLICATIONS

Metals Abstracts, No. 31-4458, Dec. 1982, "Influence of Initial Structure of Low-Carbon Dual Phase Steels on Mechanical Properties", Yoon et al.

*Primary Examiner*—Wayland Stallard

*Attorney, Agent, or Firm*—Oblon, Fisher, Spivak, McClelland & Maier

[57] ABSTRACT

High strength low carbon steels having good ultraworkability which comprises 0.01–0.3 wt % of C, below 1.5 wt % of Si, 0.3–2.5 wt % of Mn and the balance of iron and inevitable impurities. In the steel, a low temperature transformation product phase consisting of acicular martensite, bainite or a mixed structure thereof is uniformly dispersed in a ferrite phase in an amount by volume of 15–40%. Wire articles of these steels and methods for making the steels are also disclosed.

15 Claims, 10 Drawing Figures

HIGH STRENGTH LOW CARBON STEELS, STEEL ARTICLES THEREOF AND METHOD FOR MANUFACTURING THE STEELS

BACKGROUND OF THE INVENTION

1. Field of the Invention

This invention relates to high strength low carbon steels having good ultraworkability or a high degree of workability. Also, the invention relates to articles of such steels as mentioned above and a method for manufacturing the steels.

2. Description of the Prior Art

In recent years, there have been developed highly ductile steels for use as high strength thin steel sheets for press forming which consist of ferrite and a low temperature transformation product phase and which have a low yield ratio. However, it is known that although these steels have good stretch formability or bulging ability, they become very poor when subjected, for example, to a high degree of working such as wire drawing in which a reduction ratio is as high as about 90%. On the other hand, it is also known that eutectoid steels of the pearlite structure obtained by the patenting treatment are considerably poor in forgeability and press formability.

We have made intensive studies to obtain steels which have not only good press formability, but also excellent ultraworkability or a high degree of workability such as cold or hot wire drawing, drawing, forging and rolling. As a result, it was found that a high degree of workability could be imparted to low carbon steels as follows. The structure of low carbon steels is first converted to bainite martensite or a fine mixed structure thereof with or without retained austenite. The reversely transformed bulky austenite is transformed under given cooling conditions to give a final structure so that a fine low temperature transformation product phase consisting of acicular or elongated bainite, martensite or a mixed structure thereof with or without containing retained austenite is uniformly dispersed in the ferrite phase, thereby forming a composite structure.

SUMMARY OF THE INVENTION

It is accordingly an object of the present invention to provide high strength low carbon steels which have very good ultraworkability as will never been experienced in the prior art.

It is another object of the invention to provide high strength low carbon steels in which acicular martensite, bainite or a mixed structure thereof is uniformly dispersed in a ferrite phase.

It is a further object of the invention to provide a method for manufacturing such high strength low carbon steels as mentioned above.

It is a still further object of the invention to provide articles of the high strength low carbon steels.

According to one embodiment of the invention, there is provided a high strength low carbon steel having good ultraworkability which comprises 0.01–0.3 wt% of C, below 1.5 wt% of Si, 0.3–2.5 wt% of Mn and the balance of iron and inevitable impurities, the steel having such a metal structure that a low temperature transformation product phase consisting of acicular martensite, bainite or a mixed structure thereof is uniformly dispersed in a ferrite phase in an amount by volume of 15–40%.

The above steel may further comprise at least one member selected from the group consisting of 0.005–0.20 wt% of Nb, 0.005–0.3 wt% of V and 0.005–0.30 wt% of Ti.

According to another embodiment of the invention, there is also provided a method for manufacturing a high strength low carbon steel of the type mentioned above which comprises the steps of converting a structure of a starting steel comprising below 0.3 wt% of C, below 1.5 wt% of Si, 0.3–2.5 wt% of Mn and the balance of iron and inevitable impurities into a pre-structure mainly composed of martensite or bainite, or a mixed structure of ferrite and martensite or bainite, heating the converted steel at a temperature in the range of $Ac_1$–$Ac_3$, and subjecting the heated steel to controlled cooling so that the resulting final structure of the steel is a mixed structure of ferrite and a low temperature transformation product phase of martensite or bainite.

In a preferred embodiment, the high strength low carbon steel may be obtained by a method which comprises the steps of converting a structure of a starting steel having a composition of 0.01–0.30 wt% of C, below 1.5 wt% of Si, 0.3–2.5 wt% of Mn and the balance of iron and inevitable impurities into a pre-structure mainly composed of bainite, martensite or a mixed structure thereof in which a grain size of old austenite is below 35$\mu$, heating the steel to a temperature in the range of $Ac_1$–$Ac_3$ so that austenization proceeds until a ratio of austenization exceeds about 20%, and cooling the steel to a normal temperature to 500° C. at an average cooling rate of 40°–150° C./second.

The steels according to the invention have a defined chemical composition and such a composite structure as will not be known in the prior art in which a low temperature transformation product phase is uniformly dispersed or distributed in or throughout ferrite in a predetermined ratio by volume. Preferably, the acicular or elongated grains of the low temperature transformation product phase have an average calculated size as small as below 3 $\mu$m. Thus, the steels are excellent not only in ductility, but also in ultraworkability. For instance, the steel can be used for drawing at a drawing rate of 99.9% and the resultant wire has also high strength and high ductility.

It will be noted that the term "elongated or acicular grain" is intended to mean a grain having directionality. On the other hand, the term "globular grain" means a grain having no directionality. The term "calculated size" of acicular grains means a diameter of the respective acicular grain whose area is assumed as a circle.

BRIEF DESCRIPTION OF THE DRAWINGS

FIGS. 2(A) through 2(C) are microphotographs of structures of steels in which FIGS. 2(A) and 2(B) are for the present invention and FIG. 2(C) is for comparison;

DETAILED DESCRIPTION AND EMBODIMENTS OF THE INVENTION

Figure 1:
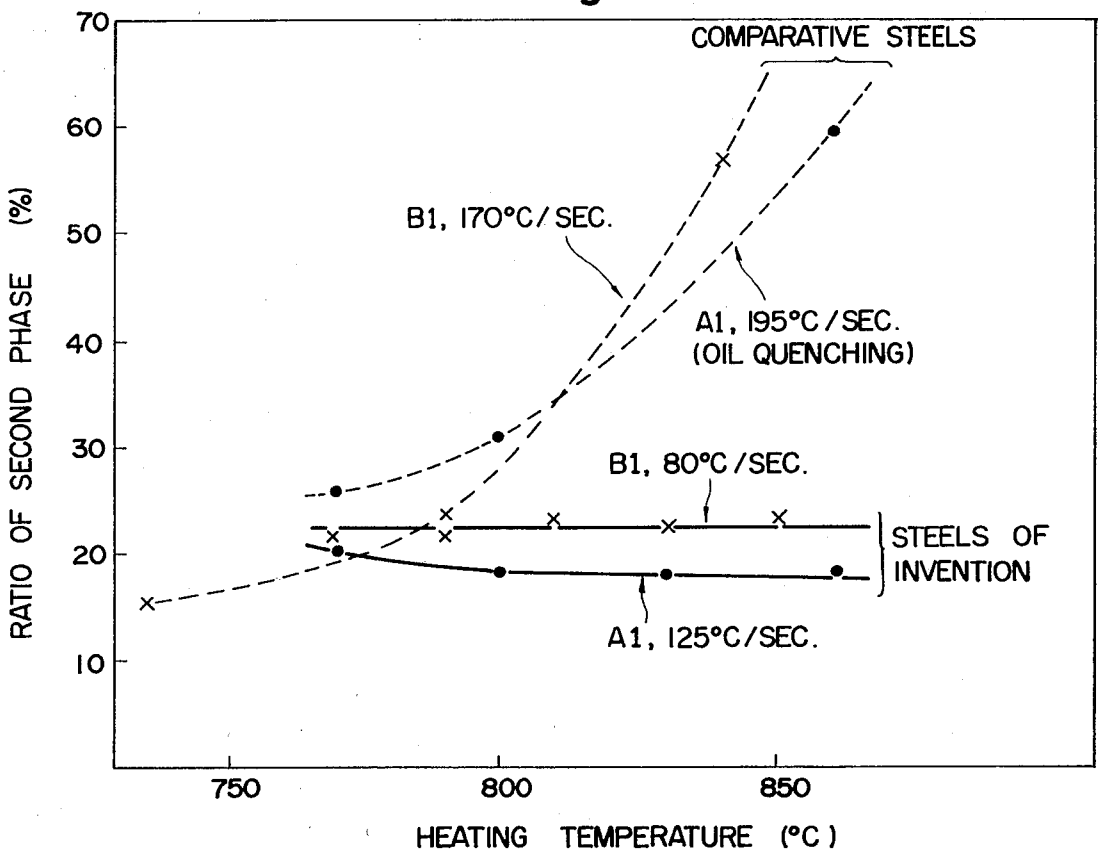
FIG. 1 is a graphical representation of a ratio by volume of a low temperature transformation product phase to a ferrite phase in relation to heating temperature in the range of $Ac_1$–$Ac_3$ for different average cooling rates.

The components of the steel of the invention are defined as described before and used in defined amounts. This is described in more detail.

C should be added to the steel in amounts not less than 0.01 wt% (hereinafter referred to merely as %) in order to permit formation of the final metallic structure defined before. When the amounts exceed 0.3%, the low temperature transformation product phase consisting of acicular martensite, bainite or a mixed structure thereof (which may often be referred to as second phase hereinafter) deteriorates in ductility. Accordingly, the content of C is in the range of 0.01–0.30%, preferably 0.02–0.15%.

Si is effective as an element of strengthening the ferrite phase. However, when the content exceeds 1.5%, the transformation temperature is moved toward a much higher temperature side, tending decarburization to occur on the surface of a steel. Thus, the upper limit is 1.5%. Preferably the content of Si is in the range of 0.01–1.2%.

Mn should be added in amounts not less than 0.3% because it serves to strengthen steels, enhance hardenability of the second phase and render the grain shape acicular or elongated. When Mn is added in large amounts over 2.5%, no additional effects cannot be expected. Thus, the content of Mn is in the range of 0.1–2.5%.

In order to permit grain refining of the metallic structure of low carbon steels, at least one element selected from the group consisting of Nb, V and Ti may be further added. For these purposes, the at least one element should be added in amounts not less than 0.005%. Too large amounts are not favorable because a further effect cannot be expected with poor economy. Accordingly, the upper limit is 0.2% for Nb and 0.3% for V or Ti.

Inevitable elements and elements which may be contained in the steel of the invention are described below.

S may be contained in the steel and the content should preferably be below 0.005 in order to reduce an amount of MnS in the steel, within which the ductility of the steel is improved. Because P is an element which causes a considerable degree of intergranular segregation, the content should preferably be not greater than 0.01%. N is an element which is most likely to age when existing in the state of solid solution. Accordingly, N ages during the course of working and will impede workability. Alternatively, aging takes place even after working and the worked steel may deteriorate in ductility. Accordingly, the content of N is preferably in the range not greater than 0.003%. Al forms an oxide inclusion which rarely deforms, so that workability of the resulting steel may be impeded. In particular, with an extremely fine wire, it is liable to break at a portion of the inclusion. Accordingly, when the steel is applied as wires or rods, the content of Al is preferably not greater than 0.01%.

on the other hand, it is preferable to control the shape of MnS inclusions by adding rare earth elements such as Ca, Ce and the like.

The addition of Al as well as Nb, V and Ti is effective in fixing dissolved C or N.

Moreover, according to the purpose or application of the steels according to the invention, Cr, Cu and/or Mo may be added in amounts not greater than 1.0%, respectively, and Ni may be added in amounts not greater than 6%. In addition, B may be added in an amount not greater than 0.02%.

The steels of the present invention which have a specific type of metallic structure are particularly useful when used as very fine wires.

In the practice of the invention, very fine wires mean steal wires having a diameter of about 2 mm or below, preferably 1.5 mm or below and obtained by cold drawing. These wires can be used as rope wires, bead wires, spring steel, hose wires, tire cords, inner wires and the like. These extremely fine wires are usually made of a rod wire with a diameter of 5.5 mm by drawing. In this case, a total reduction of area is over about 90%, which is far over a drawing limit of ordinary 0.6–0.8 medium to high carbon patenting wire rods. As a consequence, it is necessary to subject the starting rod to one or more patenting treatments during the drawing operation.

In general, pure iron or low carbon ferrite/pearlite steels may be drawn into extremely fine wires according to the strong working technique, but an increase of the strength by the drawing is small, so that the final wire product has rather poor strength. Even with a drawing operation at a working ratio as high as 95–99%, the strength is at most in the range of 70–130 kgf/mm$^2$ and cannot arrive at 170 kgf/mm$^2$ or higher. In addition, even with a drawing operation using a working or reduction ratio over 99%, the strength is below 190 kgf/mm$^2$. In other words, extremely fine wires having a strength over 240 kgf/mm$^2$ and a rupture by drawing over 30% cannot be obtained from pure iron or low carbon ferrite/pearlite steels by strong drawing.

The high strength low carbon steels according to the invention can be drawn by cold drawing at a total working ratio of 90% or higher without heating to temperatures over $Ac_1$ during the course of working. The high strength, high ductility extremely fine wires of the invention have a strength not less than 170 kgf/mm$^2$ and a rupture by drawing of not less than 40%, preferably a strength not less than 240 kgf/mm$^2$ and a rupture by drawing not less than 30%.

The manufacture of the high strength, high ductility low carbon steels of the invention is then described.

Broadly, the steel can be manufactured by a method which comprises the steps of converting a structure of a starting steel comprising below 0.3 wt% of C, below 1.5 wt% of Si, 0.3–2.5 wt% of Mn and the balance of iron and inevitable impurities into a pre-structure either mainly composed of martensite or bainite, or a mixed structure of ferrite and martensite or bainite, heating the converted steel at a temperature in the range of $Ac_1$–$Ac_3$, and subjecting the heated steel to controlled cooling so that the resulting final structure of the steel is a mixed structure of ferrite and a low temperature transformation phase of martensite or bainite.

In order to obtain the pre-structure, the following procedures are effective.

The first procedure is a method in which the starting steel is rolled under control or hot rolled, followed by accelerated cooling. The rolling under control means that with sheets, the rolling is effected, preferably, at a temperature not higher than 950° C. at a cumulative rolling reduction not less than 30% and completed at a temperature of $Ac_3 \pm 50°$ C. With rods, the intermediate to final rolling temperature is below 1000° C. within which the cumulative reduction ratio is over 30%, and the final rolling temperature is determined within a range of $Ar_3$–$Ar_3 + 100°$ C. Outside the above-defined temperature range, the pre-structure of a desired composition can rarely been obtained, or a grain-refined pre-structure can rarely be obtained. In accordance with the method of the invention, use of old austenite grains having a finer size results in higher ductility and toughness of the final steel. The cooling rate at the time of the accelerated cooling is 5° C./second or higher. Smaller cooling rates result in formation of an ordinary ferrite and pearlite structure.

The second procedure is different from the first procedure of obtaining the pre-structure of a desired composition by ordinary rolling. The second procedure comprises, after rolling, a thermal treatment of the rolled steel in which the steel is heated to a temperature range of austenite which exceeds $Ac_3$ and then cooled under control. According to this procedure, the heating temperature is preferred to be in the range of $Ac_3$–$Ac_3 + 150°$ C. similar to the case of the first procedure.

Thus, in the practice of the invention, a starting steel is so worked as to convert the structure thereof prior to heating to the range of $Ac_1$–$Ac_3$ from a known ferrite/pearlite structure into a structure mainly composed of martensite or bainite or a mixed structure of ferrite and a low temperature transformation phase of martensite or bainite with or without containing retained austenite. The steel whose pre-structure has been so controlled as described above is heated to an $Ac_1$–$Ac_3$ range, so that a multitude of pro-eutectic austenite grains are formed using, as preferred nuclei, retained austenite or cementite existing in lath-boundaries of the low temperature transformation product phase and grow along the boundaries. Martensite or bainite which is transformed from the austenite after the accelerated cooling is in the form of a lamellar structure having directionality and has good conformity with surrounding ferrite. As a result, the grains of the second phase can be more refined step by step than the case of a steel having a known ferrite/pearlite pre-structure, with a grain form completely different from the form from the known steel.

More specifically, when the ferrite/pearlite steel is heated to a temperature range of $Ac_1$–$Ac_3$, ferrite grain boundaries or ferrite/pearlite grain boundaries serve as nucleus or core-forming sites for austenite. According to the method of the invention, not only the ferrite grain boundaries and old austenite grain boundaries, but also lath-boundaries exist as preferred nucleus or core-forming sites. The martensite having directionality produced from the lath-boundaries has good selective deformability and good cold ultraworkability. Grain refining of the pre-structure accompanied by grain refining of the old martensite remarkably promotes a degree of grain refining of the martensite structure having the directionality, permitting smaller degrees of grain refinings including an intragranular space of martensite, a width of grains and a length of grains.

Addition of Ti, V, Nb and/or Zr is effective in refining of old austenite grains and is thus preferred for grain refining of a final structure. Similarly, controlled rolling is also preferred.

When the steel whose pre-structure has been thus controlled is heated to a temperature range of $Ac_1$–$Ac_3$, the heating rate is preferred to be great in order to suppress recrystallization of the low temperature transformation product phase. In general, the heating rate should be not less than 100° C./minute, preferably 500° C./minute. Subsequently, the steel is subjected to controlled cooling.

The controlled cooling pattern is not critical. Preferably, a value of C (%)/ratio by volume of the second phase (%) in the resultant steel is below 0.006. By this value, the lower limit of the ratio by volume of the second phase with respect to C content (%) is defined. If the above value exceeds 0.006, the second phase itself lowers in ductility. According to known methods, after heating to a temperature range for the ferrite/austenite, concentration of C in the retained austenite is promoted at the time of cooling so that a second hard phase is uniformly dispersed in small amount. By this, the strength obtained is about 60 kg/mm$^2$.

In a more specific embodiment, there is also provided a method for manufacturing the high strength low carbon steel of the invention. The method comprises the steps of converting a structure of a starting steel having such a composition as defined before into a phase consisting of bainite, martensite or a mixed structure thereof in which a grain size of old austenite is not larger than 35$\mu$, heating the steel to a temperature in the range of $Ac_1$–$Ac_3$ so that austenization proceeds until a ratio of austenization exceeds about 20%, and cooling the steel to a normal temperature to 500° C. at an average cooling rate of 40°–150° C./second.

In order that the second phase consisting of bainite, martensite or a mixed structure thereof in the final metal structure is a fine acicular structure, the steel is treated prior to heating to a temperature range of $Ac_1$–$Ac_3$ so that the structure thereof is converted into bainite, martensite or a very fine mixed structure, with or without retained austenite, in which the grain size of old austenite is not larger than 35$\mu$, preferably not larger than 20$\mu$. The converted structure has been called "pre-structure" hereinbefore. Grain refining of this structure results in refining of a final structure, leading to an improvement in ductility and toughness of the final steel. A required degree of strength can be imparted to the final steel.

In order to control the grain size of old austenite at not larger than 35$\mu$, steels obtained from ingots or continuous casting is hot worked in such a way that the hot working is effected at a temperature ranging from a temperature at which recrystallization or grain growth of austenite proceeds very slowly, say, below 980° C. to a temperature not lower than $Ar_3$ point at a reduction area of not less than 30%. If the hot working temperature exceeds 980° C., austenite tends to recrystallize or involve grain growth. When the reduction ratio is less than 30%, refining of austenite grains cannot be attained. In order to obtain fine grains of austenite in the order of 10–20μ, a final working pass should be below 900° C. in addition to the above working conditions. Moreover, very fine grains having a size as small as 5–10μ are obtained when the final working pass is carried out at a strain rate of not smaller than 300/second.

It will be noted that after the hot working where the size of old austenite grains is controlled, cold working may be effected to obtain a desired shape of steel. In this case, a working ratio should be up to 40% during the cold working. When the steel having such a pre-structure as described above is cold worked over 40%, recrystallization of martensite takes place upon heating to a temperature range of $Ac_1$–$Ac_3$ as will be described hereinafter, it being impossible to obtain an intended final structure.

The pre-structure may be converted into bainite, martensite or a mixed structure thereof according to the procedures described with regard to the first method.

The pre-structure is then heated to a temperature range of $Ac_1$–$Ac_3$ and cooled by which austenite is transformed into acicular martensite or bainite. The acicular grains show good conformity with surrounding ferrite phases, so that the grains in the second phase become much more refined. Accordingly, the conditions of the heating to the $Ac_1$–$Ac_3$ range and the subsequent cooling are very important. Depending on the conditions, the second phase may become globular or globular grains may be present in the second phase with the strong workability being impeded.

In more detail, reverse transformation of the pre-structure consisting of fine bainite, martensite or a mixed structure thereof by heating to an austenite range starts from formation of globular austenite from the old austenite grain boundary when a ratio of austenite is up to about 20% and subsequent formation of acicular austenite from the inside of the grains. In this state, when the steel is rapidly cooled at a cooling rate of 150°–200° C./second or higher, there is obtained a structure in which acicular and globular low temperature transformation phases are dispersed in ferrite. Accordingly, finer grains of the old austenite result in a higher frequency in formation of globular austenite. When the austenization proceeds over about 40%, acicular austenite grains combine together and convert into globular austenite. When the steel is rapidly cooled in such a state as mentioned, a mixed structure consisting of ferrite and a coarse globular low temperature transformation product phase is formed. If the austenization proceeds over about 90%, globules of austenite combine together and grow up, thus completing the austenization. If the steel is rapidly cooled in this state, there is obtained a structure mainly composed of the low temperature transformation product phase.

In the practice of the present invention, the steel having such a controlled pre-structure as described above is heated in a $Ac_1$–$Ac_3$ range, in which austenization should proceed at a ratio not less than about 20%. In this state, the steel is cooled down to a normal temperature to 500° C. at an average cooling rate of 40°–150° C./second. In the course of the transformation during the cooling, ferrite and acicular austenite are separated from globular austenite and the acicular austenite is transformed into a low temperature transformation product phase. This permits formation of a final metal structure in which the fine low temperature transformation product phase consisting of acicular bainite, martensite or a mixed structure thereof with or without partially containing retained martensite is uniformly dispersed in the ferrite phase.

The average cooling rate is defined as mentioned above. When the cooling rate is lower than 40° C./second, globular austenite or polygonal ferrite is formed, and retained globular austenite grains are transformed into a globular second phase. On the other hand, when the cooling rate is higher than 150° C./second, the globular second phase is unfavorably formed. In the steels of the invention, a ratio by volume of the second phase should be in the range of 15–40%. Within this range, the grains in the second phase are acicular in shape and have an average calculated size not larger than 3μ. Thus, the steels of the invention have such a specific type of composite structure with a high degree of workability as will never been experienced in the prior art. Outside the above range, there is the tendency that the globular second phase is formed in the final structure even when the steel is cooled under conditions indicated above.

The cooling termination temperature is in the range of from a normal temperature to 500° C. This is because not only bainite, martensite or a mixed structure thereof is obtained as the low temperature transformation product phase, but also the cooling rate is caused slow or the cooling is terminated within the above temperature range, so that the resulting second phase can be tempered.

The present invention is more particularly described by way of examples.

EXAMPLE 1

Steels A and B of the present invention having chemical compositions indicated in Table 1 were each rolled and cooled with water to obtain steels A1 and B1 each of which had a fine martensite structure as a pre-structure. For comparison, steel A was rolled and cooled in air to obtain steel A2 having a ferrite/pearlite structure as the pre-structure. In all the steels, the size of the old austenite grains was below 20μ.

The steels A1 and B1 were heated for 3 minutes at a temperature in the range of $Ac_1$–$Ac_3$ so that different ratios of austenite were obtained, followed by cooling to a normal temperature at different average cooling rates. The ratio by volume of the grains in the second phase is shown in FIG. 1 in relation to heating temperature for different cooling rates. Indicated by the solid lines are uniformly mixed structures of ferrite and the second acicular phase and by broken lines are mixed structures of ferrite and the second globular phase or ferrite and the second acicular or globular phase.

When the steels were cooled at an average cooling rate of 125° C./second or 80° C./second according to the present invention, the form of the second phase in the steels was found to be acicular. The structure formed was a structure in which the second acicular phase was uniformly dispersed in the ferrite phase. The ratio by volume of the second phase was maintained almost constant irrespective of the heating temperature. In contrast, even when the same pre-structure was used but the average cooling rate was over 170° C./second, inclusive, the second phase was found to be globules or a mixture of globular and acicular phases. The ratio of the second phase became higher at higher temperatures.

Figure 2A:
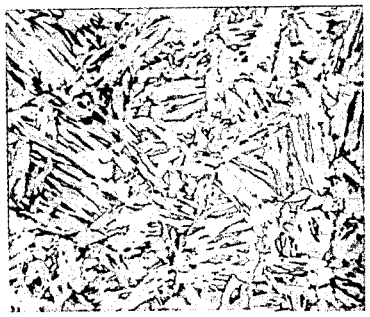
Figure 2B:
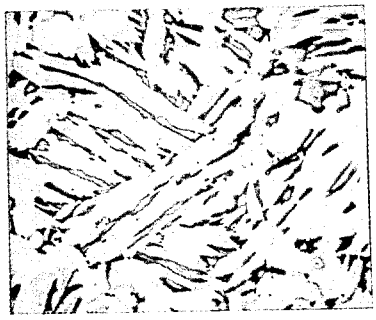
Figure 2C:
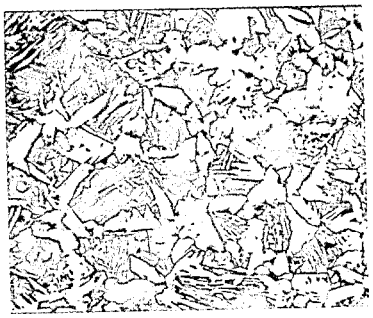
Figure 3:
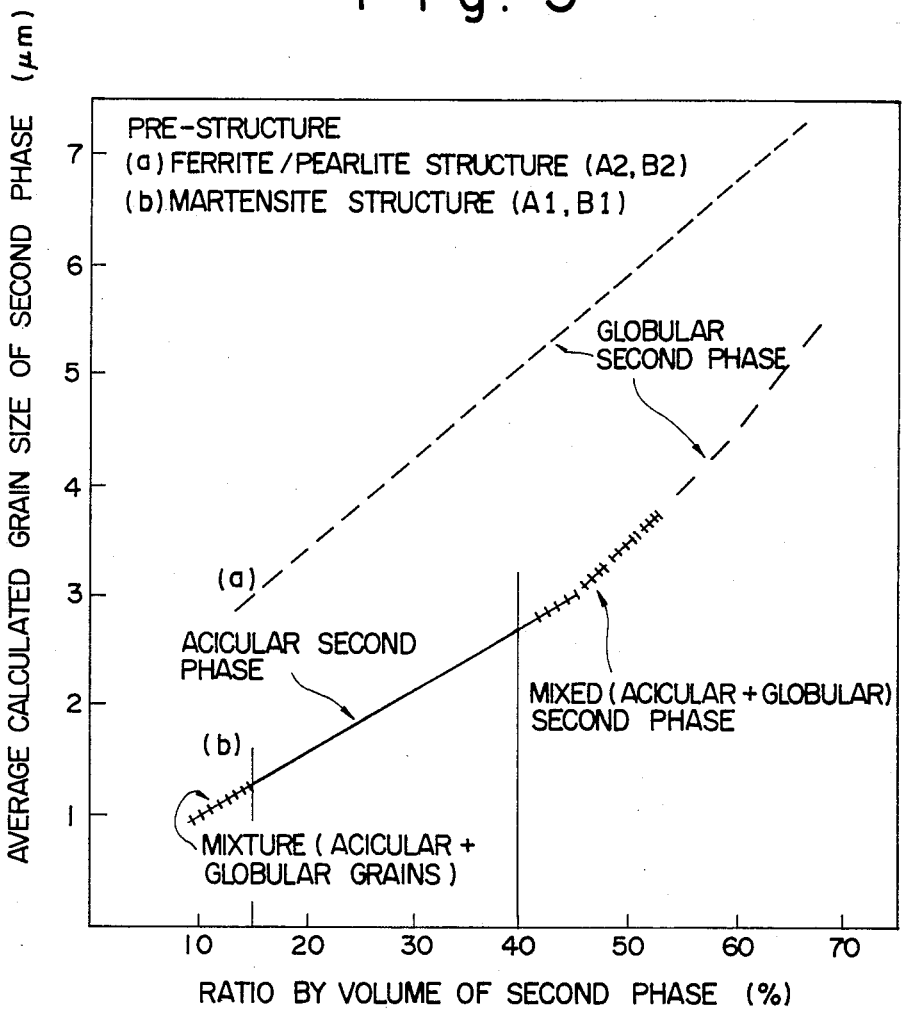
FIG. 3 is a graphical representation of the relation between average calculated size of the low temperature transformation product phase and a ratio by volume of the transformation product phase while depicting a grain form of the transformation product phase.

Microphotographs of typical structures of the steels of the invention obtained from A1 are shown in FIGS. 2(A) and 2(B) with magnifying powers of 700 and 1700, respectively. In the microphotographs, the white portions are the ferrite phase and the black portions are the acicular martensite phase. FIG. 2(C) is a microphotograph showing a structure of steel No. 7 in Table 2 used for comparison with a magnifying power of 700. FIG. 3 shows the relation between average calculated size of the second phase grains and the ratio by volume of the second phase for A1 and B1 having the martensite pre-structure and A2 and B2 having the ferrite/pearlite pre-structure. As defined before, the average calculated size means an average diameter in case where an area of a grain with any form is calculated as a circle.

In any steels, the size of the second phase grains increases with an increase of the ratio by volume of the second phase. When the ratio by volume of the second phase is kept constant, the size of the grains obtained from the martensite pre-structure is much smaller than than a size of grains obtained from the ferrite/pearlite pre-structure. In other words, even with steels having the same composition, if the pre-structure is changed from ferrite/pearlite to martensite structures, the grains in the second phase can be refined to a substantial extent. By the refining of the second phase grains, the steel is much improved in ductility but has not always a high degree of workability. According to the present invention, the ratio by volume of the second phase is defined in the range of 15–40%, so that the form of the second phase becomes chiefly acicular, with the second phase consisting of fine acicular grains having an average calculated size not larger than 3μ. When such fine acicular grains as the second phase are uniformly dispersed in or throughout the ferrite, good ultraworkability can be imparted to the resultant steel. As a matter of course, the above is true of the case where the second phase consists of acicular bainite or a mixed structure of acicular bainite and martensite.

With regard to steel A1 of the invention and comparative steel A2, heating and cooling conditions, final structure and mechanical properties are shown in Table 2. Steel Nos. 2, 4, 5 and 6 which are obtained by heating steel A1 whose pre-structure is fine martensite to a temperature range of $Ac_1$–$Ac_3$ so that the rate of austenization exceeds 20%, and then cooled at 125° C./second are steels of the invention. These steels have composite structures in which fine acicular martensite (second phase) is uniformly dispersed in ferrite at a ratio by volume of 15–40%. Thus, the steels have very good strength and ductility.

In contrast, comparative steel A2 whose pre-structure is ferrite/pearlite gives steel Nos. 10, 11 and 12 having a globular second phase irrespective of heating and cooling conditions. All these steels are inferior in strength and ductility balance. On the other hand, steel No. 1 whose pre-structure is martensite is cooled at too slow a cooling rate after heating to the $Ac_1$–$Ac_3$ range. Steel No. 2 is heated to the $Ac_1$–$Ac_3$ range so that the rate of austenization is 16%. Both steels have fine mixed structures of ferrite and globular and acicular martensite and are superior in strength and ductility balance to steel Nos. 10–12. However, the steel Nos. 1 and 2 are apparently inferior to the steels of the invention. Steel Nos. 7–9 all have mixed structures of ferrite and globular martensite and are inferior in strength and ductility balance.

Subsequently, wire rods with a diameter of 6.4 mm having different forms of the second phase were subjected to cold drawing at a high degree of working. The properties of the wires after the cold drawing are shown in Table 3. According to the steel of the invention as No. 1, it has good ductility even when a degree of working is 99% and can be worked at a very high degree. In addition, the worked steel has a good balance of strength and ductility. On the other hand, the steel No. 2 having the second globular phase sharply deteriorates in ductility as the degree of working increases and is broken at a degree of working of about 90%. The steel No. 3 has a finer structure than the steel No. 2 and is superior in ultraworkability to the steel No. 2. However, the steel No. 3 has poorer properties after working than the steel No. 1.

Figure 4:
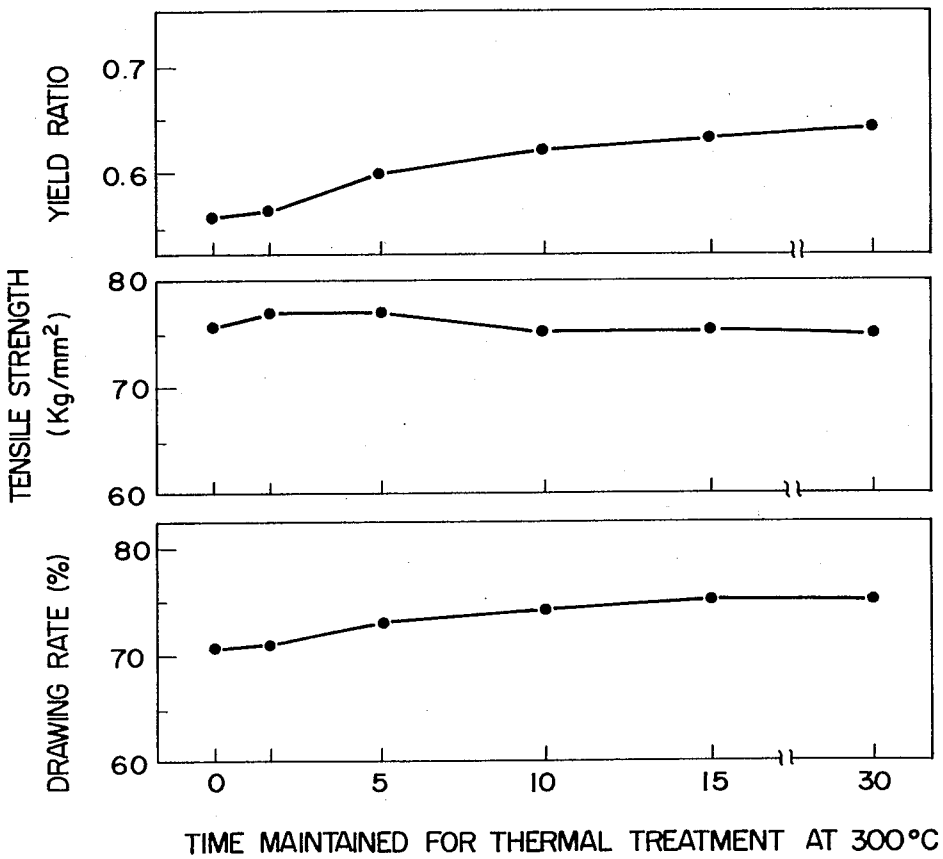
FIG. 4 is a graphical representation of physical properties in relation to time for which a steel of the invention is maintained at 300° C.

FIG. 4 shows variations of physical characteristics of the steel of the invention as No. 4 indicated in Table 2 when the steel was thermally treated for certain times at a temperature of 300° C. The changes in strength and ductility are relatively small and the yield ratio is maintained at low values even when the steel is kept at 300° C. for 30 minutes. This concerns with the fact that the steel of the invention has low contents of dissolved C and N in the cooled state. On the other hand, when a similar thermal treatment is carried out after the working, the yield ratio is remarkably improved and thus a combination of working and low temperature thermal treatment is possible according to the purpose.

The steels B and C of the invention having such chemical compositions indicated in Table 1 were drawn, according to the present invention, into wires having a fine uniform composite structure of ferrite and acicular martensite and a diameter of 5.5 mm. The resultant wires are designated as B1 and C1, respectively. The mechanical properties of B1 and C1 and mechanical properties of wires obtained by drawing the the B1 and C1 wires into very fine wires having a diameter below 1.0 mm at a high degree of working are shown in Table 4.

B1 and C1 have both high ductility and can be worked at a degree as high as 99.9%. The drawn wires have also high strength and high ductility and thus the steels of the present invention can be suitably applied as fine wires. On the other hand, the steel C1 was drawn at a degree of working of 97% to obtain a wire having a diameter of 0.95 mm and subsequently annealed at low temperatures of 300°–400° C. The mechanical properties of the wire are shown in Table 4, from which it is revealed that the ductility is improved by the low temperature annealing without a lowering of strength. During the course of the drawing of the steels of the invention, it is preferable to effect the low temperature annealing in order to increase ductility of a final wire. In addition, the low temperature annealing may be applied as a homogenizing treatment of a plated layer which is applied after the final drawing.

TABLE 1

| Steel | Chemical Components (wt %) | | | | | | | |
|---|---|---|---|---|---|---|---|---|
| Symbol | C | Si | Mn | P | S | Al | N | Nb |
| A | 0.09 | 0.79 | 1.36 | 0.020 | 0.018 | 0.007 | 0.0068 | — |
| B | 0.07 | 0.34 | 1.46 | 0.011 | 0.006 | 0.007 | 0.0044 | 0.022 |
| C | 0.07 | 0.49 | 1.47 | 0.001 | 0.0008 | 0.007 | 0.0018 | — |

TABLE 2

| Steel No. | Steel Symbol | Heating Temp. (°C.) | Rate of Austenization (%) | Cooling Rate (°C./sec.) | Second Phase of In Final Structure Content (%) | Second Phase of In Final Structure Form[a] | Yield Strength (kg/mm²) | Tensile Strength (kg/mm²) | Yield Ratio | Total[b] Elongation (%) | Reduction of Area (%) | Remarks |
|---|---|---|---|---|---|---|---|---|---|---|---|---|
| 1 | A1 | 800 | 33 | 17 | 13 | Δ | 35.1 | 58.7 | 0.60 | 32.5 | 70 | Comparison |
| 2 | A1 | 760 | 16 | 125 | 11 | Δ | 46.2 | 66.0 | 0.70 | 35.1 | 77 | Comparison |
| 3 | A1 | 850 | 56 | 125 | 21 | o | 38.8 | 75.8 | 0.52 | 35.2 | 68 | Invention |
| 4 | A1 | 800 | 33 | 125 | 18 | o | 38.5 | 77.0 | 0.50 | 34.2 | 71 | Invention |
| 5 | A1 | 830 | 38 | 125 | 17 | o | 39.1 | 76.1 | 0.51 | 34.0 | 74 | Invention |
| 6 | A1 | 860 | 66 | 125 | 18 | o | 37.9 | 76.4 | 0.50 | 35.2 | 73 | Invention |
| 7 | A1 | 900 | 100 | 125 | 68 | x | 85.9 | 100.3 | 0.86 | 16.9 | 56 | Comparison |
| 8 | A1 | 800 | 33 | 195 | 36 | x | 61.5 | 92.4 | 0.68 | 26.3 | 55 | Comparison |
| 9 | A1 | 860 | 66 | 195 | 59 | x | 75.2 | 103.7 | 0.72 | 21.8 | 61 | Comparison |
| 10 | A2 | 830 | 35 | 17 | 14 | x | 34.8 | 55.2 | 0.63 | 31.2 | 54 | Comparison |
| 11 | A2 | 860 | 60 | 125 | 41 | x | 45.0 | 79.6 | 0.58 | 24.3 | 68 | Comparison |
| 12 | A2 | 860 | 60 | 195 | 56 | x | 77.6 | 96.0 | 0.81 | 13.5 | 53 | Comparison |

Note
[a]o: Uniform structure in which acicular martensite is dispersed in ferrite (steels of the invention).
x: Mixed structure of ferrite and globular martensite (comparative steels).
Δ: Mixed structure of ferrite and globular and acicular martensite (comparative steels).

[b]Distance between gages = $5.64\sqrt{\text{sectional area}}$ .

TABLE 3

| Steel No. | Steel Symbol | Diameter of Wire (mm) | Wire Drawing Ratio (%) | Tensile Strength (kg/mm²) | Drawing Rate (%) | Form of Second Phase[(a)] | Remarks |
|---|---|---|---|---|---|---|---|
| 1 | A1 | 6.4 | 0 | 76 | 74 | o | Steels of Invention |
| | | 4.0 | 61 | 120 | 67 | | |
| | | 3.0 | 78 | 141 | 66 | | |
| | | 2.0 | 90 | 170 | 58 | | |
| | | 1.5 | 95 | 182 | 55 | | |
| | | 1.0 | 98 | 221 | 53 | | |
| | | 0.7 | 99 | 248 | 49 | | |
| 2 | A2 | 6.4 | 0 | 73 | 62 | x | Comparative Steels |
| | | 4.0 | 61 | 104 | 41 | | |
| | | 3.0 | 78 | 126 | 33 | | |
| | | 2.0[(b)] | 90 | 148 | 11 | | |
| 3 | A1 | 6.4 | 0 | 84 | 66 | Δ | Comparative Steels |
| | | 4.0 | 61 | 123 | 54 | | |
| | | 3.0 | 78 | 140 | 45 | | |
| | | 2.0 | 90 | 169 | 31 | | |

Note
[(a)]Same as in Table 2.
[(b)]Broken on the way of the wire drawing.

TABLE 4

| Steel No. | Steel Symbol | Diameter of wire (mm) | Wire Drawing Ratio (%) | Tensile Strength (kg/mm²) | Drawing Rate (%) | Treating Conditions |
|---|---|---|---|---|---|---|
| 1 | B1 | 5.5 | 0 | 69 | 76 | After thermal treatment and cooling*[(a)] |
| | | 1.0 | 96.7 | 191 | 55 | After drawing |
| | | 0.8 | 97.9 | 204 | 53 | |
| | | 0.5 | 99.2 | 228 | 50 | |
| | | 0.38 | 99.5 | 243 | 46 | |
| | | 0.25 | 99.8 | 271 | 44 | |
| | | 0.20 | 99.9 | 297 | 41 | |
| 2 | C1 | 5.5 | 0 | 68 | 82 | After thermal treatment and cooling*[(b)] |
| | | 0.95 | 97.0 | 200 | 52 | After drawing |
| | | 0.95 | 97.0 | 204 | 62 | After 350° C. × 3 seconds annealing*[(c)] |
| | | 0.95 | 97.0 | 200 | 56 | After 400° C. × 3 seconds annealing*[(c)] |
| | | 0.95 | 97.0 | 207 | 64 | After 300° × 10 minutes anneal- |

TABLE 4-continued

| Steel No. | Steel Symbol | Diameter of wire (mm) | Wire Drawing Ratio (%) | Tensile Strength (kg/mm²) | Drawing Rate (%) | Treating Conditions |
|---|---|---|---|---|---|---|
| | | | | | | ing*(d) |

Note
(a)After heating at 800° C. for 3 minutes, cooled down to room temperature at a rate of 80° C./second.
(b)After heating at 810° C. for 2 minutes, cooled down to room temperature at 125° C./second.
(c)Thermal treatment in a salt bath.
(d)Thermal treating using an electric furnace.

EXAMPLE 2

Steel Nos. I through IV having chemical compositions defined by the present invention as indicated in Table 5 were thermally treated as follows.

Treatment R1: Intermediate and finishing rolling temperatures were controlled at 915° C. or below. In the temperature range, the steels were each rolled a total rolling reduction of 86% and the rolling was completed at 840° C., followed by cooling with water to obtain a steel mainly composed of martensite.

Treatment R2: Intermediate and finishing temperatures were controlled at 930° C. or below and the rolling was effected at a rolling reduction of 96% within the above temperature range and completed at 895° C., followed by cooling in air to form a mixed structure of ferrite and a low temperature transformation product phase.

Treatment H: A wire having a diameter of 7.5 mm was heated at different temperatures indicated below and ice-cooled to form a structure mainly composed of martensite. The heating temperatures at 900° C., 1000° C. and 1100° C. were designated as treatments H1, H2 and H3, respectively.

For comparison, the following heat treatment was conducted.

Treatment C: After ordinary hot rolling, a steel was allowed to cool to form a ferrite/pearlite structure.

The wires obtained from steels whose pre-structures were controlled by any of the thermal treatments indicated above were placed in an electric furnace which could be heated to a temperature ranging from 745°-840° C. and heated in predetermined temperatures, followed by oil quenching to obtain mixed structures of ferrite and a low temperature transformation product phase.

Figure 5:
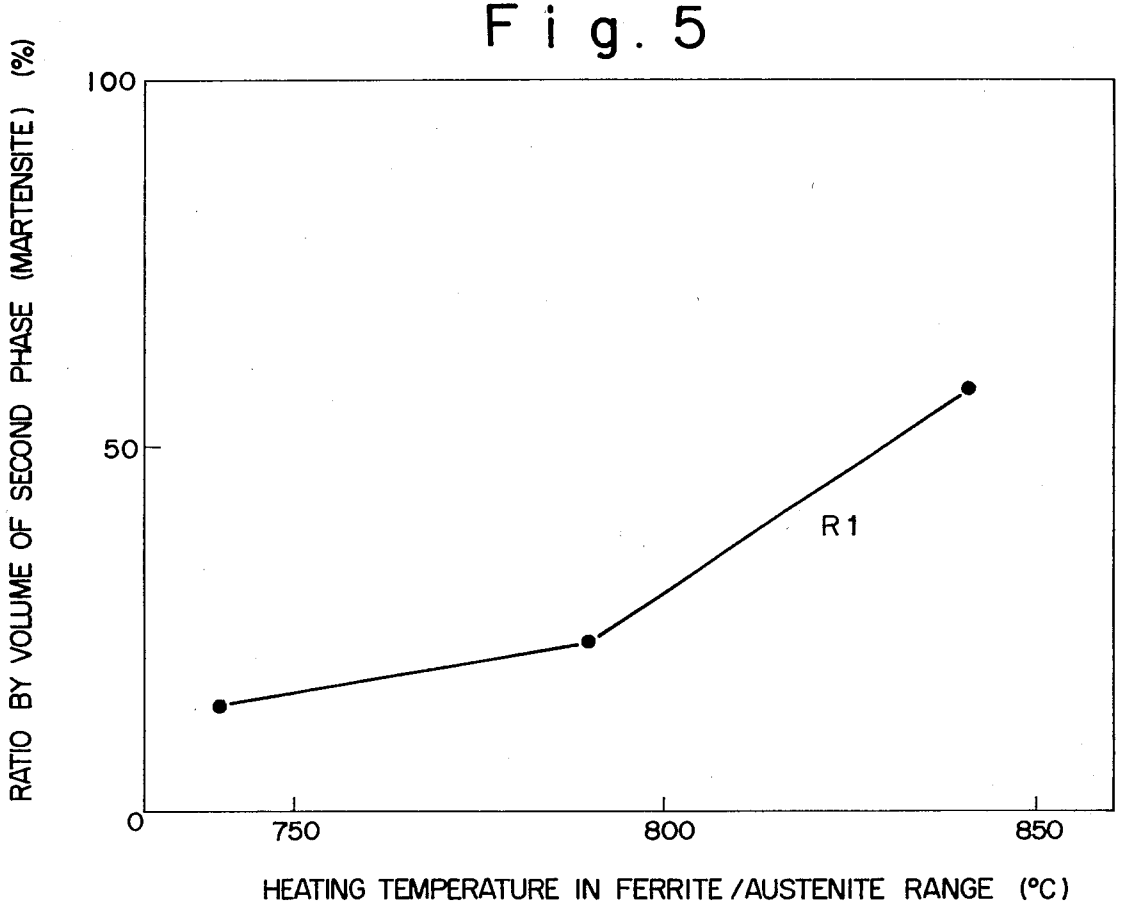
FIG. 5 is a graphical representation of a ratio by volume of martensite (low temperature transformation product phase) in a wire made of a steel of the invention in relation to heating temperature.
Figure 6:
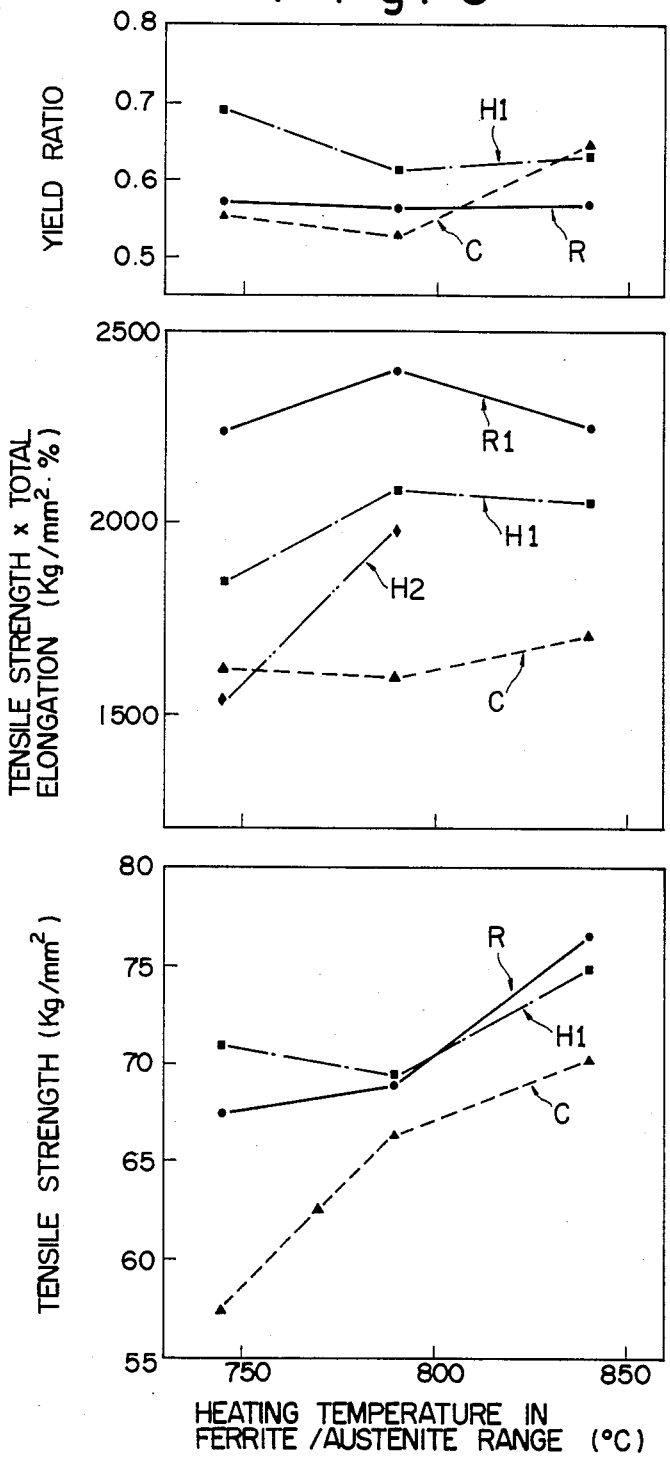
FIG. 6 is a graphical representation of physical properties of the wire used in connection with FIG. 5 in relation to heating temperature.

FIG. 5 shows the relation between ratio by volume of the second phase and heating temperature of the wire obtained from steel No. I. FIG. 6 shows mechanical properties of the wire obtained with regard to FIG. 5 in relation to the heating temperature. As will be apparent from the figures, the strength and total elongation balance suffers a great influence depending on the type of pre-structure. In particular, even when the ratio by volume of the second phase is increased to about 50% to impart high strength, a good strength/total elongation balance is obtained as with the steels obtained by the treatments R1 and R2.

EXAMPLE 3

Wires made of steels indicated as I, II, III and IV were treated to have predetermined pre-structures indicated in Table 6, followed by heating to 790° C. and oil quenched. The resultant wires had mechanical properties and a ratio by volume of the second phase in the final structure as shown in Table 6. All the steels had a value of a C content (%) in steel/a ratio by volume of the second phase (%) ranging from 0.0032 to 0.0052. An increase of the C content in steel results in an increase of the ratio by volume of the second phase, with the result that high strength is obtained.

Figure 7:
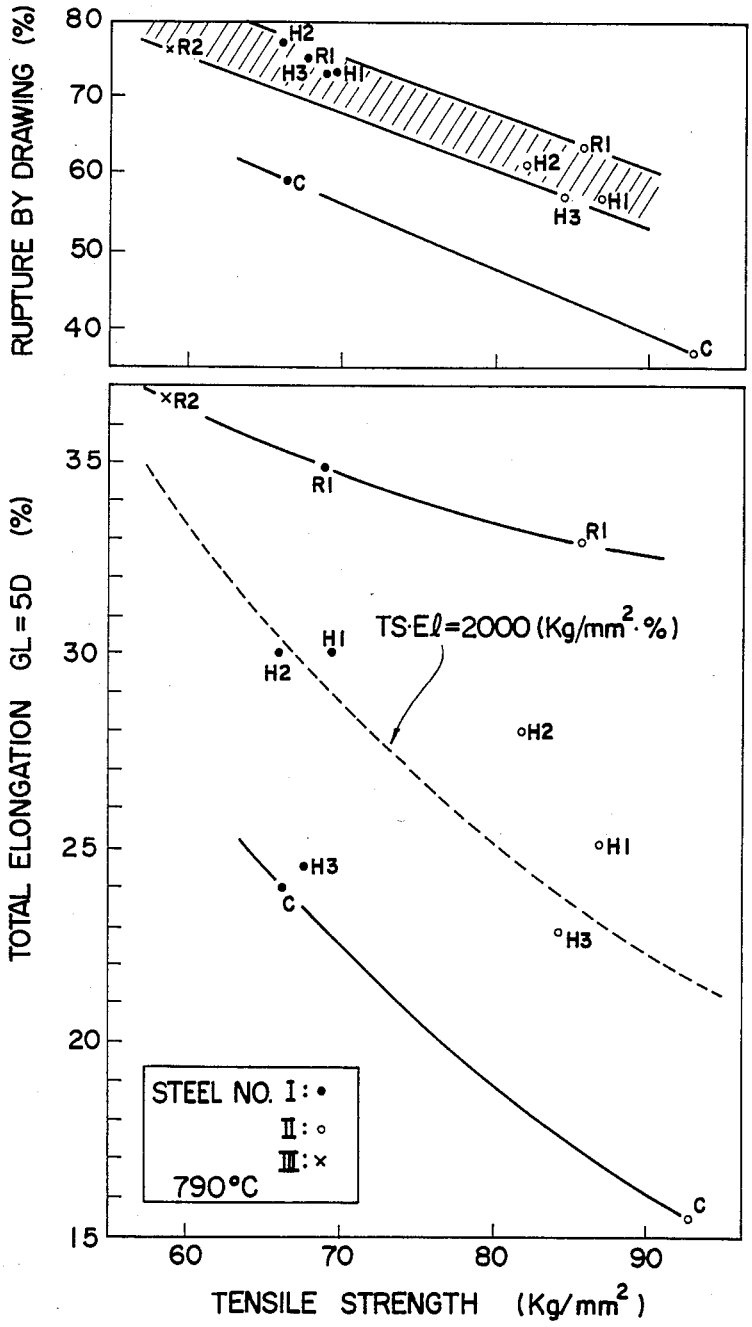
FIG. 7 is a graphical representation of rupture by drawing and total elongation in relation to tensile strength.

FIG. 7 is depicted on the basis of the results of Table 6 and shows rupture by drawing and total elongation in relation to tensile strength. As compared with a known steel (treatment C) having a ferrite/pearlite structure obtained by ordinary hot rolling and allowing to cool, the steels of the invention are much high in rupture by drawing. As a result, as shown in Table 7, the Charpy absorption energy and transition temperature are improved.

The strength/ductility balance indicated by strength x total elongation of the steels of the present invention is almost equal to or higher than an upper limit, say, 2000 kg/mm².%, of a steel with a mixed structure applied as a known thin steel sheet of the grade having 50-60 kg/mm². In particular, the steels subjected to the treatments R1 and R2 have a much improved strength-/ductility balance.

Figure 8:
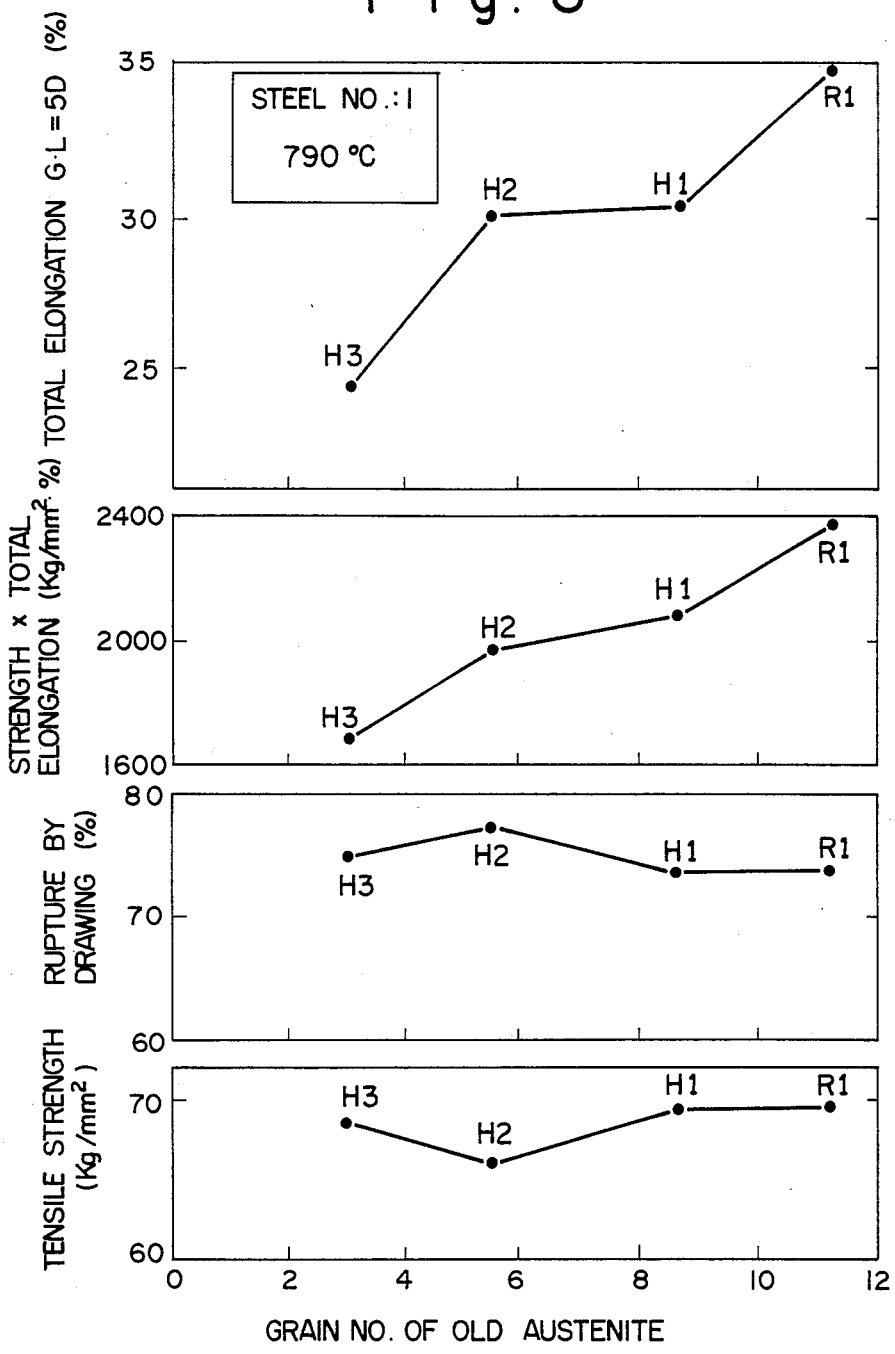
FIG. 8 is a graphical representation of physical properties of a steel after thermal treatment in relation to a size of old austenite with a structure prior to heating to the $Ac_1$–$Ac_3$ range.

FIG. 8 shows mechanical properties of steels after thermal treatments in relation to a size of old austenite grains prior to heating to an $Ac_1$-$Ac_3$ temperature range. From the figure, it will be seen that a finer size of the old austenite grains leads to more improved total elongation and strength/ductility balance. As shown in Table 6, the Charpy toughness of the R1 steel is superior to the toughness of the H3 steel. This is because of the refining of the old austenite grains.

TABLE 5

| Steel No. | C | Si | Mn | P | S | Cr | Nb |
|---|---|---|---|---|---|---|---|
| I | 0.07 | 0.34 | 1.46 | 0.011 | 0.006 | — | 0.022 |
| II | 0.15 | 0.32 | 1.45 | 0.013 | 0.005 | — | — |
| III | 0.07 | 0.19 | 1.49 | 0.009 | 0.008 | 0.51 | — |
| IV | 0.21 | 0.46 | 1.65 | 0.017 | 0.011 | — | — |

TABLE 6

| Steel No. | Wire Diameter (mm) | Pre-treatment | Grain No. of Austenite | Yield strength (kg/mm²) | Tensile strength (kg/mm²) | Yield ratio | Total elongation | Reduction of Area (%) | Volume by percent of second phase in | C %/volume by % of second phase | Remarks |
|---|---|---|---|---|---|---|---|---|---|---|---|
| I | 7.5 | R1 | 11.3 | 38.3 | 68.9 | 0.56 | 34.8 | 73 | 22 | 0.0032 | Steel of Invention |

TABLE 6-continued

| Steel No. | Wire Diameter (mm) | Pre-treatment | Grain No. of Austenite | Yield strength (kg/mm²) | Tensile strength (kg/mm²) | Yield ratio | Total elongation | Reduction of Area (%) | Volume by percent of second phase in | C %/volume by % of second phase | Remarks |
|---|---|---|---|---|---|---|---|---|---|---|---|
| | | C | — | 34.5 | 66.2 | 0.52 | 23.9 | 59 | 21 | 0.0033 | Comparative Invention |
| | | H1 | 8.6 | 42.5 | 69.2 | 0.61 | 29.9 | 73 | 21 | 0.0033 | Steel of Invention |
| | | H2 | 5.5 | 41.8 | 65.8 | 0.62 | 30.0 | 77 | 20 | 0.0035 | Steel of Invention |
| | | H3 | 3.0 | 52.2 | 68.6 | 0.76 | 24.5 | 75 | 19 | 0.0037 | Steel of Invention |
| II | 7.5 | R1 | 12.0 | 50.2 | 85.4 | 0.59 | 32.8 | 63 | 29 | 0.0052 | Steel of Invention |
| | | C | — | 60.4 | 92.3 | 0.65 | 15.3 | 36 | 30 | 0.0050 | Comparative Invention |
| | | H1 | 8.3 | 51.3 | 86.6 | 0.59 | 25.1 | 57 | 32 | 0.0047 | Steel of Invention |
| | | H2 | 4.7 | 47.8 | 81.7 | 0.59 | 28.0 | 61 | 29 | 0.0052 | Steel of Invention |
| | | H3 | 3.2 | 56.7 | 84.2 | 0.67 | 22.8 | 57 | 34 | 0.0044 | Steel of Invention |
| III | 10.0 | R2 | — | 35.7 | 58.4 | 0.61 | 36.7 | 76 | 16 | 0.0043 | Steel of Invention |
| IV | 10.0 | R2 | — | 78.3 | 126.5 | 0.62 | 15.9 | 23 | 47 | 0.0045 | Steel of Invention |

Note:

In the measurement of total elongation, the distance between gages was determined as 5 × diameter of wire diameter, i.e. 5.64 $\sqrt{\text{sectional area}}$

TABLE 7

| | Pre-treatment | Absorption Energy (kg · m) | Transition temp. (°C.) | Strength range (kg/mm²) |
|---|---|---|---|---|
| I | R1 | 1.15 | <−200 | 70 |
| | H3 | 1.11 | −201 | |
| | C | 0.90 | −79 | |
| II | R1 | 1.02 | <−100 | 90 |
| | H3 | 0.89 | −131 | |
| | C | 0.67 | +2 | |
| Annealing and Tempering of SCM 3 | | 0.73 | −103 | |

Note: The test piece used had a similar figure (¼) of JIS No. 5

What is claimed is:

1. A high strength low carbon steel having good ultraworkability which consists essentially of 0.01–0.3 wt% of C, below 1.2 wt% of Si, 0.3–2.5 wt% of Mn and the balance of iron and inevitable impurities, the steel having such a metal structure that a low temperature transformation product phase having an average calculated size not larger than 3 microns consisting of acicular martensite, bainite or a mixed structure thereof is uniformly dispersed in a ferrite phase in an amount by volume of 15–40%.

2. The high strength low carbon steel according to claim 1, wherein a content of C is in the range of 0.02–0.15 wt%, a content of Si is in range of 0.01–1.2 wt%, and a content of Mn is in the range of 0.1–2.5 wt%.

3. The high strength low carbon steel according to claim 1, further consisting essentially of at least one member selected from the group consisting of 0.005–0.20 wt% of Nb, 0.005–0.30 wt% of V and 0.005–0.30 wt% of Ti.

4. A high strength and high ductility fine steel wire made of a high strength low carbon steel having good ultraworkability which consists essentially of 0.01–0.3 wt% of C, below 1.2 wt% of Si, 0.3–2.5 wt% of Mn and the balance of iron and inevitable impurities, the steel having such a metal structure that a low temperature transformation product phase having an average calculated size not larger than 3 microns consisting of acicular martensite, bainite or a mixed structure thereof is uniformly dispersed in a ferrite phase in an amount by volume of 15–40%, said steel being cold drawn to a total reduction ratio not less than 90%.

5. The high strength low carbon steel according to claim 4, wherein a content of C is in the range of 0.02–0.15 wt%, a content of Si is in range of 0.01–1.2 wt%, and a content of Mn is in the range of 0.1–2.5 wt%.

6. The high strength low carbon steel according to claim 4, further consisting essentially of at least one member selected from the group consisting of 0.005–0.20 wt% of Nb, 0.005–0.30 wt% of V and 0.005–0.30 wt% of Ti.

7. A method for manufacturing a high strength low carbon steel having good ultraworkability which comprises the steps of converting a structure of a starting steel comprising below 0.3 wt% of C, below 1.5 wt% of Si, 0.3–2.5 wt% of Mn and the balance of iron and inevitable impurities into a pre-structure mainly composed of martensite or bainite, or a mixed structure of ferrite and martensite or bainite, heating the converted steel at a temperature in the range of $Ac_1$–$Ac_3$, and subjecting the heated steel to controlled cooling so that the resulting final structure of the steel is a mixed structure of ferrite and a low temperature transformation product phase of acicular martensite or bainite.

8. The method according to claim 7, wherein the starting steel is subjected to controlled rolling or hot rolling and accelerated cooling to obtain the pre-structure.

9. The method according to claim 8, wherein a cooling rate at the time of accelerated cooling is not less than 5° C./second.

10. The method according to claim 7, wherein the heating step comprises a heating rate not less than 100° C./minute.

11. The method according to claim 10, wherein the heating rate is not less than 500° C./second.

12. The method according to claim 7, wherein a ratio of a percent content of C in the steel to a ratio by volume of the low temperature transformation product phase in the final structure is less than 0.006, inclusive.

13. A method for manufacturing a high strength low carbon steel having good ultraworkability which comprises the steps of converting a structure of a starting steel having a composition of 0.01–0.30 wt% of C, below 1.5 wt% of Si, 0.3–2.5 wt% of Mn and the balance of iron and inevitable impurities into a pre-structure of bainite, martensite or a mixed structure thereof in which a grain size of old austenite is below 35$\mu$, heating the steel to a temperature in the range of $Ac_1$–$Ac_3$ so that austenization proceeds until a ratio of austenization exceeds about 20%, and cooling the steel to a normal temperature to 500° C. at an average cooling rate of 40°–150° C./second to achieve an acicular martensitic or bainitic phase.

14. The method according to claim 13, wherein the starting steel is subjected to controlled rolling or hot rolling and accelerated cooling to obtain the pre-structure.

15. The method according to claim 13, wherein a cooling rate at the time of accelerated cooling is not less than 5° C./second.

* * * * *